US010551044B2

(12) United States Patent
Peng et al.

(10) Patent No.: US 10,551,044 B2
(45) Date of Patent: Feb. 4, 2020

(54) RECESSED LIGHTING ASSEMBLY

(71) Applicant: DMF, Inc., Carson, CA (US)

(72) Inventors: Xinzhi Peng, Long Beach, AR (US); Michael D. Danesh, Beverly Hills, CA (US)

(73) Assignee: DMF, Inc., Carson, CA (US)

( * ) Notice: Subject to any disclaimer, the term of this patent is extended or adjusted under 35 U.S.C. 154(b) by 764 days.

(21) Appl. No.: 14/942,937

(22) Filed: Nov. 16, 2015

(65) Prior Publication Data

US 2017/0138576 A1 May 18, 2017

(51) Int. Cl.
*F21V 23/00* (2015.01)
*F21S 8/02* (2006.01)
*F21V 17/18* (2006.01)

(52) U.S. Cl.
CPC ..... *F21V 23/001* (2013.01); *F21S 8/02* (2013.01); *F21V 17/18* (2013.01)

(58) Field of Classification Search
CPC .... F21V 23/001; F21V 17/18; F21V 2115/10; F21V 17/12; F21V 21/04; F21V 21/041; F21V 21/047; F21V 21/048; F21V 21/049; F21S 8/02
USPC ..... 362/365
See application file for complete search history.

(56) References Cited

U.S. PATENT DOCUMENTS

| | | | |
|---|---|---|---|
| 2,038,784 | A | 4/1936 | Ghadiali |
| 2,197,737 | A | 4/1940 | Appleton |
| 2,528,989 | A | 11/1950 | Ammells |
| 2,642,246 | A | 6/1953 | Larry |
| D180,844 | S | 8/1957 | Poliakoff |
| 3,023,920 | A | 3/1962 | Cook et al. |
| 3,422,261 | A | 1/1969 | McGinty |
| 3,460,299 | A | 8/1969 | Wilson |
| 3,650,046 | A | 3/1972 | Skinner |
| 3,711,053 | A | 1/1973 | Drake |
| D227,989 | S | 7/1973 | Geisel |
| 3,812,342 | A | 5/1974 | Mcnamara |
| D245,905 | S | 9/1977 | Taylor |
| 4,088,827 | A | 5/1978 | Kohaut |
| 4,154,218 | A | 5/1979 | Hulet |
| 4,154,219 | A | 5/1979 | Gupta et al. |
| 4,176,758 | A | 12/1979 | Glick |
| 4,399,497 | A | 8/1983 | Druffel |
| 4,520,435 | A | 5/1985 | Baldwin |
| 4,601,145 | A | 7/1986 | Wilcox |
| 4,723,747 | A | 2/1988 | Karp et al. |

(Continued)

FOREIGN PATENT DOCUMENTS

| | | | |
|---|---|---|---|
| CA | 2502637 | A1 | 9/2005 |
| CA | 2691480 | C | 4/2012 |

(Continued)

OTHER PUBLICATIONS

U.S. Non-Final Office Action, dated May 17, 2017, U.S. Appl. No. 14/183,424.

(Continued)

*Primary Examiner* — Bao Q Truong
*Assistant Examiner* — Jessica M Apenteng
(74) *Attorney, Agent, or Firm* — Smith Baluch LLP

(57) ABSTRACT

A fire-resistant, recessed lighting unit that obviates the need for a separate junction box and a separate incandescent "can". Other embodiments are also described and claimed.

26 Claims, 6 Drawing Sheets

(56) References Cited

U.S. PATENT DOCUMENTS

| | | | |
|---|---|---|---|
| 4,729,080 | A | 3/1988 | Fremont et al. |
| 4,754,377 | A | 6/1988 | Wenman |
| 4,930,054 | A | 5/1990 | Krebs |
| 5,216,203 | A | 6/1993 | Gower |
| 5,250,269 | A | 10/1993 | Langer et al. |
| 5,266,050 | A | 11/1993 | O'Neil et al. |
| 5,382,752 | A | 1/1995 | Reyhan et al. |
| 5,444,606 | A | 8/1995 | Barnes et al. |
| 5,465,199 | A | 11/1995 | Bray et al. |
| 5,505,419 | A | 4/1996 | Gabrius |
| 5,544,870 | A | 8/1996 | Kelly et al. |
| 5,562,343 | A | 10/1996 | Chan et al. |
| 5,571,993 | A | 11/1996 | Jones et al. |
| 5,580,158 | A | 12/1996 | Aubrey et al. |
| 5,588,737 | A | 12/1996 | Kusmer |
| 5,603,424 | A | 2/1997 | Bordwell et al. |
| 5,613,338 | A | 3/1997 | Esposito |
| D381,111 | S | 7/1997 | Lecluze |
| 5,662,413 | A | 9/1997 | Akiyama |
| D386,277 | S | 11/1997 | Lecluze |
| D387,466 | S | 12/1997 | Lecluze |
| 5,738,436 | A | 4/1998 | Cummings et al. |
| 5,836,678 | A | 11/1998 | Wright et al. |
| 5,942,726 | A | 8/1999 | Reiker |
| 5,944,412 | A | 9/1999 | Janos et al. |
| 6,082,878 | A | 7/2000 | Doubek et al. |
| 6,105,334 | A | 8/2000 | Monson et al. |
| 6,161,910 | A | 12/2000 | Reisenauer et al. |
| 6,170,685 | B1 | 1/2001 | Currier |
| 6,174,076 | B1 | 1/2001 | Petrakis et al. |
| 6,176,599 | B1 | 1/2001 | Farzen |
| 6,267,491 | B1 | 7/2001 | Parrigin |
| 6,332,597 | B1 | 12/2001 | Korcz et al. |
| 6,350,043 | B1 | 2/2002 | Gloisten |
| 6,364,511 | B1 | 4/2002 | Cohen |
| 6,402,112 | B1 | 6/2002 | Thomas et al. |
| D461,455 | S | 8/2002 | Forbes |
| 6,461,016 | B1 | 10/2002 | Jamison et al. |
| 6,474,846 | B1 | 11/2002 | Kelmelis et al. |
| 6,491,413 | B1 | 12/2002 | Benesohn |
| D468,697 | S | 1/2003 | Straub, Jr. |
| 6,515,313 | B1 | 2/2003 | Ibbetson et al. |
| 6,583,573 | B2 | 6/2003 | Bierman |
| 6,585,389 | B2 | 7/2003 | Bonazzi |
| 6,600,175 | B1 | 7/2003 | Baretz et al. |
| D478,872 | S | 8/2003 | Heggem |
| 6,657,236 | B1 | 12/2003 | Thibeault et al. |
| 6,666,419 | B1 | 12/2003 | Vrame |
| D488,583 | S | 4/2004 | Benghozi |
| 6,719,438 | B2 | 4/2004 | Sevack et al. |
| 6,758,578 | B1 | 7/2004 | Chou |
| 6,777,615 | B1 | 8/2004 | Gretz |
| 6,827,229 | B2 | 12/2004 | Dinh et al. |
| 6,906,352 | B2 | 6/2005 | Edmond et al. |
| D509,314 | S | 9/2005 | Rashidi |
| 6,948,829 | B2 | 9/2005 | Verdes et al. |
| 6,958,497 | B2 | 10/2005 | Emerson et al. |
| 6,964,501 | B2 | 11/2005 | Ryan |
| D516,235 | S | 2/2006 | Rashidi |
| 7,064,269 | B2 | 6/2006 | Smith |
| D528,673 | S | 9/2006 | Maxik et al. |
| D531,740 | S | 11/2006 | Maxik |
| D532,532 | S | 11/2006 | Maxik |
| 7,148,420 | B1 | 12/2006 | Johnson et al. |
| 7,154,040 | B1 | 12/2006 | Tompkins |
| 7,170,015 | B1 | 1/2007 | Roesch et al. |
| D536,349 | S | 2/2007 | Humber et al. |
| D537,039 | S | 2/2007 | Pincek |
| D539,229 | S | 3/2007 | Murphey |
| 7,186,008 | B2 | 3/2007 | Patti |
| 7,190,126 | B1 | 3/2007 | Paton |
| 7,211,833 | B2 | 5/2007 | Slater, Jr. et al. |
| 7,213,940 | B1 | 5/2007 | Van De Ven et al. |
| D547,889 | S | 7/2007 | Huang |
| D552,969 | S | 10/2007 | Bobrowski et al. |
| D553,267 | S | 10/2007 | Yuen |
| D555,106 | S | 11/2007 | Pape et al. |
| D556,144 | S | 11/2007 | Dinh |
| 7,297,870 | B1 | 11/2007 | Sartini |
| 7,312,474 | B2 | 12/2007 | Emerson et al. |
| 7,320,536 | B2 | 1/2008 | Petrakis et al. |
| D561,372 | S | 2/2008 | Yan |
| D561,373 | S | 2/2008 | Yan |
| 7,335,920 | B2 | 2/2008 | Denbaars et al. |
| D563,896 | S | 3/2008 | Greenslate |
| 7,347,580 | B2 | 3/2008 | Blackman et al. |
| D570,012 | S | 5/2008 | Huang |
| 7,374,308 | B2 | 5/2008 | Sevack et al. |
| D570,504 | S | 6/2008 | Maxik et al. |
| D570,505 | S | 6/2008 | Maxik et al. |
| 7,399,104 | B2 | 7/2008 | Rappaport |
| D578,677 | S | 10/2008 | Huang |
| 7,431,482 | B1 | 10/2008 | Morgan et al. |
| 7,432,440 | B2 | 10/2008 | Hull et al. |
| 7,442,883 | B2 | 10/2008 | Jolly et al. |
| 7,446,345 | B2 | 11/2008 | Emerson et al. |
| 7,473,005 | B2 | 1/2009 | O'Brien |
| 7,488,097 | B2 | 2/2009 | Reisenauer et al. |
| 7,503,145 | B2 | 3/2009 | Newbold et al. |
| 7,524,089 | B2 | 4/2009 | Park |
| D591,894 | S | 5/2009 | Flank |
| 7,534,989 | B2 | 5/2009 | Suehara et al. |
| D596,154 | S | 7/2009 | Rivkin |
| 7,566,154 | B2 | 7/2009 | Gloisten et al. |
| D599,040 | S | 8/2009 | Alexander et al. |
| D600,836 | S | 9/2009 | Hanley et al. |
| 7,588,359 | B2 | 9/2009 | Coushaine et al. |
| 7,592,583 | B2 | 9/2009 | Page et al. |
| D606,696 | S | 12/2009 | Chen et al. |
| 7,625,105 | B1 | 12/2009 | Johnson |
| 7,628,513 | B2 | 12/2009 | Chiu |
| 7,651,238 | B2 | 1/2010 | O'Brien |
| 7,654,705 | B2 | 2/2010 | Czech et al. |
| D611,650 | S | 3/2010 | Broekhoff |
| 7,670,021 | B2 | 3/2010 | Chou |
| 7,673,841 | B2 | 3/2010 | Wronski |
| 7,677,766 | B2 | 3/2010 | Boyer |
| 7,692,182 | B2 | 4/2010 | Bergmann et al. |
| 7,704,763 | B2 | 4/2010 | Fujii et al. |
| D616,118 | S | 5/2010 | Thomas et al. |
| 7,722,208 | B1 | 5/2010 | Dupre et al. |
| 7,722,227 | B2 | 5/2010 | Zhang et al. |
| 7,735,795 | B2 | 6/2010 | Wronski |
| 7,735,798 | B2 | 6/2010 | Kojima |
| 7,748,887 | B2 | 7/2010 | Zampini, II et al. |
| 7,766,518 | B2 | 8/2010 | Piepgras et al. |
| 7,769,192 | B2 | 8/2010 | Takagi et al. |
| 7,771,082 | B2 | 8/2010 | Peng |
| 7,771,094 | B2 | 8/2010 | Goode |
| D624,692 | S | 9/2010 | Mackin et al. |
| D625,847 | S | 10/2010 | Maglica |
| D625,876 | S | 10/2010 | Chen et al. |
| D627,727 | S | 11/2010 | Alexander et al. |
| 7,828,465 | B2 | 11/2010 | Roberge et al. |
| D629,366 | S | 12/2010 | Ericson et al. |
| 7,871,184 | B2 | 1/2011 | Peng |
| 7,874,539 | B2 | 1/2011 | Wright et al. |
| 7,874,709 | B1 | 1/2011 | Beadle |
| D633,224 | S | 2/2011 | Lee |
| D636,903 | S | 4/2011 | Torenbeek |
| D637,339 | S | 5/2011 | Hasan et al. |
| D637,340 | S | 5/2011 | Hasan et al. |
| 7,950,832 | B2 | 5/2011 | Tanaka et al. |
| D639,499 | S | 6/2011 | Choi et al. |
| D640,819 | S | 6/2011 | Pan |
| 7,959,332 | B2 | 6/2011 | Tickner et al. |
| 7,967,480 | B2 | 6/2011 | Pickard et al. |
| D642,317 | S | 7/2011 | Rashidi |
| 7,972,035 | B2 | 7/2011 | Boyer |
| 7,972,043 | B2 | 7/2011 | Schutte |
| D642,536 | S | 8/2011 | Robinson |
| D643,970 | S | 8/2011 | Kim et al. |
| D646,011 | S | 9/2011 | Rashidi |
| 8,013,243 | B2 | 9/2011 | Korcz et al. |

(56) References Cited

U.S. PATENT DOCUMENTS 8,038,113 B2 10/2011 Fryzek et al.
D648,476 S 11/2011 Choi et al.
D648,477 S 11/2011 Kim et al.
D650,115 S 12/2011 Kim et al.
8,070,328 B1 12/2011 Knoble et al.
8,096,670 B2 1/2012 Trott et al.
D654,205 S 2/2012 Rashidi
D656,263 S 3/2012 Ogawa et al.
8,142,057 B2 3/2012 Roos et al.
8,152,334 B2 4/2012 Krogman
D658,788 S 5/2012 Dudik et al.
D658,802 S 5/2012 Chen
D659,862 S 5/2012 Tsai
D659,879 S 5/2012 Rashidi
D660,814 S 5/2012 Wilson
8,182,116 B2 5/2012 Zhang et al.
8,201,968 B2 6/2012 Maxik et al.
D663,058 S 7/2012 Pan
D663,466 S 7/2012 Rashidi
D664,274 S 7/2012 de Visser et al.
D664,705 S 7/2012 Kong et al.
8,215,805 B2 7/2012 Cogliano et al.
8,220,970 B1 7/2012 Khazi
8,226,270 B2 7/2012 Yamamoto et al.
8,240,630 B2 8/2012 Wronski
D667,155 S 9/2012 Rashidi
8,262,255 B1 9/2012 Rashidi
D668,372 S 10/2012 Renshaw et al.
D668,809 S 10/2012 Rashidi
D669,198 S 10/2012 Qui
D669,199 S 10/2012 Chuang
D669,620 S 10/2012 Rashidi
8,277,090 B2 10/2012 Fryzek et al.
8,308,322 B2 11/2012 Santiago et al.
D673,869 S 1/2013 Yu
D676,263 S 2/2013 Birke
D676,814 S 2/2013 Paul
8,376,593 B2 2/2013 Bazydola et al.
D677,417 S 3/2013 Rashidi
D677,634 S 3/2013 Korcz et al.
D679,047 S 3/2013 Tickner et al.
8,403,533 B1 3/2013 Paulsel
8,403,541 B1 3/2013 Rashidi
D681,259 S 4/2013 Kong
8,408,759 B1 4/2013 Rashidi
D682,459 S 5/2013 Gordin et al.
D683,063 S 5/2013 Lopez et al.
D683,890 S 6/2013 Lopez et al.
D684,269 S 6/2013 Wang et al.
D684,719 S 6/2013 Rashidi
D685,118 S 6/2013 Rashidi
D685,120 S 6/2013 Rashidi
8,454,204 B1 6/2013 Chang et al.
D685,507 S 7/2013 Sun
D687,586 S 8/2013 Rashidi
D687,587 S 8/2013 Rashidi
D687,588 S 8/2013 Rashidi
D687,980 S 8/2013 Gravely et al.
D688,405 S 8/2013 Kim et al.
D690,049 S 9/2013 Rashidi
D690,864 S 10/2013 Rashidi
D690,865 S 10/2013 Rashidi
D690,866 S 10/2013 Rashidi
D691,314 S 10/2013 Rashidi
D691,315 S 10/2013 Samson
D691,763 S 10/2013 Hand et al.
8,550,669 B2 10/2013 Macwan et al.
D693,043 S 11/2013 Schmalfuss et al.
D693,517 S 11/2013 Davis
D694,456 S 11/2013 Rowlette, Jr. et al.
8,573,816 B2 11/2013 Negley et al.
D695,441 S 12/2013 Lui et al.
D696,446 S 12/2013 Huh
D696,447 S 12/2013 Huh
D696,448 S 12/2013 Huh
8,602,601 B2 12/2013 Khazi et al.
D698,067 S 1/2014 Rashidi
D698,068 S 1/2014 Rashidi
8,622,361 B2 1/2014 Wronski
D698,985 S 2/2014 Lopez et al.
D699,384 S 2/2014 Rashidi
D699,687 S 2/2014 Baldwin et al.
D700,387 S 2/2014 Snell
8,641,243 B1 2/2014 Rashidi
8,659,034 B2 2/2014 Baretz et al.
D701,175 S 3/2014 Baldwin et al.
D701,466 S 3/2014 Clifford et al.
8,672,518 B2 3/2014 Boomgaarden et al.
D702,867 S 4/2014 Kim et al.
D703,843 S 4/2014 Cheng
8,684,569 B2 4/2014 Pickard et al.
D705,472 S 5/2014 Huh
8,727,582 B2 5/2014 Brown et al.
D708,381 S 7/2014 Rashidi
8,777,449 B2 7/2014 Ven et al.
D710,529 S 8/2014 Lopez et al.
8,801,217 B2 8/2014 Oehle et al.
8,820,985 B1 9/2014 Tam et al.
8,833,013 B2 9/2014 Harman
D714,989 S 10/2014 Rowlette, Jr. et al.
8,870,426 B2 10/2014 Biebl et al.
8,890,414 B2 11/2014 Rowlette, Jr. et al.
D721,845 S 1/2015 Lui et al.
8,939,418 B2 1/2015 Green et al.
D722,296 S 2/2015 Taylor
D722,977 S 2/2015 Hagarty
D722,978 S 2/2015 Hagarty
8,950,898 B2 2/2015 Catalano
D726,363 S 4/2015 Danesh
D726,949 S 4/2015 Redfern
9,004,435 B2 4/2015 Wronski
9,039,254 B2 5/2015 Danesh
D731,689 S 6/2015 Bernard et al.
9,062,866 B1 6/2015 Christ et al.
9,065,264 B2 6/2015 Cooper et al.
9,068,719 B2 6/2015 Van De Ven et al.
D734,525 S 7/2015 Gordin et al.
D735,012 S 7/2015 Cowie
D735,142 S 7/2015 Hagarty
9,078,299 B2 7/2015 Ashdown
D739,590 S 9/2015 Redfern
9,140,441 B2 9/2015 Goelz et al.
D742,325 S 10/2015 Leung
9,151,457 B2 10/2015 Pickard et al.
9,151,477 B2 10/2015 Pickard et al.
9,217,560 B2 12/2015 Harbers et al.
9,222,661 B2 12/2015 Kim et al.
9,239,131 B1 1/2016 Wronski et al.
9,285,103 B2 3/2016 Van De Ven et al.
9,291,319 B2 3/2016 Kathawate et al.
9,301,362 B2 3/2016 Dohn et al.
D754,078 S 4/2016 Baldwin et al.
D754,079 S 4/2016 Baldwin et al.
D754,605 S 4/2016 McMillan
9,303,812 B2 4/2016 Green et al.
9,310,038 B2 4/2016 Athalye
9,322,543 B2 4/2016 Hussell et al.
9,347,655 B2 5/2016 Boomgaarden et al.
9,366,418 B2 6/2016 Gifford
9,371,966 B2 6/2016 Rowlette, Jr. et al.
D762,181 S 7/2016 Lin
9,395,051 B2 7/2016 Hussell et al.
D762,906 S 8/2016 Jeswani et al.
D764,079 S 8/2016 Wu
9,404,639 B2 8/2016 Bailey et al.
9,417,506 B1 8/2016 Tirosh
D766,185 S 9/2016 Hagarty
D767,199 S 9/2016 Wronski et al.
9,447,917 B1 9/2016 Wronski et al.
D768,325 S 10/2016 Xu
D768,326 S 10/2016 Guzzini
D769,501 S 10/2016 Jeswani et al.
D770,065 S 10/2016 Tittle
9,476,552 B2 10/2016 Myers et al.

(56) References Cited

U.S. PATENT DOCUMENTS

D776,324 S 1/2017 Gierl et al.
D777,967 S 1/2017 Redfern
9,534,751 B2 1/2017 Maglica et al.
D778,241 S 2/2017 Holbrook et al.
D778,484 S 2/2017 Guzzini
D779,100 S 2/2017 Redfern
9,581,302 B2 2/2017 Danesh
9,599,315 B1 3/2017 Harpenau et al.
9,605,910 B2 3/2017 Swedberg et al.
D785,228 S 4/2017 Guzzini
D786,472 S 5/2017 Redfern
D786,474 S 5/2017 Fujisawa
D788,330 S 5/2017 Johnson et al.
D790,102 S 6/2017 Guzzini
9,673,597 B2 6/2017 Lee
9,689,541 B2 6/2017 Wronski
D791,709 S 7/2017 Holton
D791,711 S 7/2017 Holton
D791,712 S 7/2017 Holton
9,696,021 B2 7/2017 Wronski
9,702,516 B1 7/2017 Vasquez et al.
D795,820 S 8/2017 Wengreen
9,732,904 B1 8/2017 Wronski
9,739,464 B2 8/2017 Wronski
9,791,111 B1 10/2017 Huang et al.
9,803,839 B2 10/2017 Visser et al.
D805,660 S 12/2017 Creasman et al.
D809,176 S 1/2018 Partington
9,863,619 B2 1/2018 Mak
D809,465 S 2/2018 Keirstead
9,964,266 B2 5/2018 Danesh
D820,494 S 6/2018 Cohen
9,995,441 B2 6/2018 Power et al.
D824,494 S 7/2018 Martins et al.
D832,218 S 10/2018 Wronski et al.
D833,977 S 11/2018 Danesh et al.
10,139,059 B2 11/2018 Danesh
D836,976 S 1/2019 Reese et al.
D848,375 S 5/2019 Danesh et al.
2002/0172047 A1 11/2002 Ashley
2003/0006353 A1 1/2003 Dinh et al.
2003/0021104 A1 1/2003 Tsao
2003/0161153 A1 8/2003 Patti
2004/0001337 A1 1/2004 Defouw et al.
2005/0225966 A1 10/2005 Hartmann et al.
2005/0227536 A1 10/2005 Gamache et al.
2005/0231962 A1 10/2005 Koba et al.
2005/0237746 A1 10/2005 Yiu
2006/0005988 A1 1/2006 Jorgensen
2006/0158873 A1 7/2006 Newbold et al.
2006/0198126 A1 9/2006 Jones
2006/0215408 A1 9/2006 Lee
2006/0237601 A1 10/2006 Rinderer
2006/0243877 A1 11/2006 Rippel
2006/0250788 A1 11/2006 Hodge et al.
2007/0035951 A1 2/2007 Tseng
2007/0185675 A1 8/2007 Papamichael et al.
2007/0200039 A1 8/2007 Petak
2007/0206374 A1 9/2007 Petrakis et al.
2008/0112168 A1 5/2008 Pickard et al.
2008/0112170 A1 5/2008 Trott
2008/0112171 A1 5/2008 Patti et al.
2008/0137347 A1 6/2008 Trott et al.
2008/0165545 A1 7/2008 O'Brien
2008/0232116 A1 9/2008 Kim
2008/0247181 A1 10/2008 Dixon
2009/0003009 A1 1/2009 Tessnow et al.
2009/0034261 A1 2/2009 Grove
2009/0080189 A1 3/2009 Wegner
2009/0086484 A1 4/2009 Johnson
2009/0135613 A1 5/2009 Peng
2009/0141500 A1 6/2009 Peng
2009/0141506 A1 6/2009 Lan et al.
2009/0141508 A1 6/2009 Peng
2009/0147517 A1 6/2009 Li
2009/0161356 A1 6/2009 Negley et al.
2009/0237924 A1 9/2009 Ladewig
2009/0280695 A1 11/2009 Sekela et al.
2009/0283292 A1 11/2009 Lehr
2009/0290343 A1 11/2009 Brown et al.
2010/0014282 A1 1/2010 Danesh
2010/0061108 A1 3/2010 Zhang et al.
2010/0110690 A1 5/2010 Hsu et al.
2010/0110698 A1 5/2010 Harwood et al.
2010/0148673 A1 6/2010 Stewart et al.
2010/0149822 A1 6/2010 Cogliano et al.
2010/0165643 A1 7/2010 Russo et al.
2010/0244709 A1 9/2010 Steiner et al.
2010/0246172 A1 9/2010 Liu
2010/0259919 A1 10/2010 Khazi et al.
2010/0270903 A1 10/2010 Jao et al.
2010/0302778 A1 12/2010 Dabiet et al.
2011/0043040 A1 2/2011 Porter et al.
2011/0063831 A1 3/2011 Cook
2011/0068687 A1 3/2011 Takahasi et al.
2011/0069499 A1 3/2011 Trott et al.
2011/0080750 A1 4/2011 Jones et al.
2011/0116276 A1 5/2011 Okamura et al.
2011/0134634 A1 6/2011 Gingrich, III et al.
2011/0134651 A1 6/2011 Berman
2011/0170294 A1 7/2011 Mier-Langner et al.
2011/0194299 A1 8/2011 Crooks et al.
2011/0216534 A1 9/2011 Tickner et al.
2011/0226919 A1 9/2011 Fryzek et al.
2011/0255292 A1 10/2011 Shen
2011/0267828 A1 11/2011 Bazydola et al.
2011/0285314 A1 11/2011 Carney et al.
2012/0020104 A1 1/2012 Biebl et al.
2012/0074852 A1 3/2012 Delnoij
2012/0106176 A1 5/2012 Lopez et al.
2012/0113642 A1 5/2012 Catalano
2012/0140442 A1 6/2012 Woo et al.
2012/0162994 A1 6/2012 Wasniewski et al.
2012/0182744 A1 7/2012 Santiago et al.
2012/0188762 A1 7/2012 Joung et al.
2012/0243237 A1 9/2012 Toda et al.
2012/0287625 A1 11/2012 Macwan et al.
2012/0305868 A1 12/2012 Callahan et al.
2013/0009552 A1 1/2013 Page
2013/0010476 A1 1/2013 Pickard et al.
2013/0033872 A1 2/2013 Randolph et al.
2013/0051012 A1 2/2013 Oehle et al.
2013/0141913 A1 6/2013 Sachsenweger
2013/0163254 A1 6/2013 Chang et al.
2013/0170232 A1 7/2013 Park et al.
2013/0170233 A1 7/2013 Nezu et al.
2013/0258677 A1 10/2013 Fryzek et al.
2013/0265750 A1 10/2013 Pickard et al.
2013/0271989 A1 10/2013 Hussell et al.
2013/0294084 A1 11/2013 Kathawate et al.
2013/0301252 A1 11/2013 Hussell et al.
2013/0322062 A1 12/2013 Danesh
2013/0322084 A1 12/2013 Ebisawa
2013/0335980 A1 12/2013 Nakasuji et al.
2014/0036497 A1 2/2014 Hussell et al.
2014/0049957 A1 2/2014 Goelz et al.
2014/0063776 A1 3/2014 Clark et al.
2014/0071679 A1* 3/2014 Booth ..... F21V 29/2212
362/249.02
2014/0071687 A1 3/2014 Tickner et al.
2014/0140490 A1 5/2014 Roberts et al.
2014/0063818 A1 6/2014 Randolph et al.
2014/0233246 A1 8/2014 Lafreniere et al.
2014/0254177 A1 9/2014 Danesh
2014/0268836 A1 9/2014 Thompson
2014/0299730 A1 10/2014 Green et al.
2014/0321122 A1 10/2014 Domagala et al.
2014/0347848 A1 11/2014 Pisavadia et al.
2015/0009676 A1 1/2015 Danesh
2015/0138779 A1 5/2015 Livesay et al.
2015/0184837 A1 7/2015 Zhang et al.
2015/0198324 A1 7/2015 O'Brien et al.
2015/0219317 A1 8/2015 Gatof et al.
2015/0233556 A1 8/2015 Danesh

(56) References Cited

U.S. PATENT DOCUMENTS

| | | | |
|---|---|---|---|
| 2015/0241039 | A1 | 8/2015 | Fryzek |
| 2015/0263497 | A1 | 9/2015 | Korcz et al. |
| 2015/0276185 | A1 | 10/2015 | Bailey et al. |
| 2015/0308662 | A1 | 10/2015 | Vice et al. |
| 2015/0345761 | A1 | 12/2015 | Lawlor |
| 2015/0362159 | A1 | 12/2015 | Ludyjan |
| 2016/0209007 | A1 | 7/2016 | Belmonte et al. |
| 2016/0308342 | A1 | 10/2016 | Witherbee et al. |
| 2016/0312987 | A1 | 10/2016 | Danesh |
| 2016/0348860 | A1 | 12/2016 | Bailey et al. |
| 2016/0348861 | A1 | 12/2016 | Bailey et al. |
| 2016/0366738 | A1 | 12/2016 | Boulanger et al. |
| 2017/0045213 | A1 | 2/2017 | Williams et al. |
| 2017/0059135 | A1 | 3/2017 | Jones |
| 2017/0138576 | A1 | 5/2017 | Peng et al. |
| 2017/0138581 | A1 | 5/2017 | Doust |
| 2017/0307188 | A1 | 10/2017 | Oudina et al. |

FOREIGN PATENT DOCUMENTS

| | | | |
|---|---|---|---|
| CA | 2734369 | A1 | 10/2013 |
| CA | 2561459 | A1 | 11/2013 |
| CA | 2815067 | | 11/2013 |
| CA | 2848289 | A1 | 10/2014 |
| CN | 201059503 | Y | 5/2008 |
| CN | 201259125 | Y | 6/2009 |
| CN | 101608781 | A | 12/2009 |
| CN | 201636626 | U | 11/2010 |
| CN | 102062373 | A | 5/2011 |
| CN | 202392473 | U | 11/2011 |
| CN | 103307518 | A | 3/2012 |
| CN | 202733693 | U | 2/2013 |
| CN | 103322476 | A | 9/2013 |
| CN | 203215483 | U | 9/2013 |
| CN | 101498411 | B | 11/2013 |
| CN | 104654142 | A | 11/2013 |
| CN | 203273663 | U | 11/2013 |
| CN | 203297980 | U | 11/2013 |
| CN | 103712135 | B | 12/2013 |
| CN | 203628464 | U | 12/2013 |
| CN | 203641919 | U | 6/2014 |
| CN | 204300818 | U | 4/2015 |
| CN | 204513161 | U | 7/2015 |
| CN | 204611541 | U | 9/2015 |
| CN | 204786225 | U | 11/2015 |
| CN | 204829578 | U | 12/2015 |
| CN | 205606362 | U | 9/2016 |
| CN | 2016130742 | U | 4/2017 |
| CN | 103154606 | B | 5/2017 |
| CN | 206222112 | U | 6/2017 |
| CN | 107013845 | A | 8/2017 |
| CN | 107084343 | A | 8/2017 |
| DE | 9109828 | U1 | 2/1992 |
| DE | 199 47 208 | | 5/2001 |
| EP | 1 672 155 | A1 | 6/2006 |
| EP | 2 306 072 | A1 | 4/2011 |
| EP | 2 453 169 | A2 | 5/2012 |
| EP | 2 193 309 | B1 | 7/2012 |
| EP | 2 735 787 | A1 | 5/2014 |
| EP | 3 104 024 | A1 | 12/2016 |
| GB | 2427020 | A | 12/2006 |
| GB | 2509772 | A | 7/2014 |
| JP | H02113002 | U | 9/1990 |
| JP | 2007091052 | A | 4/2007 |
| JP | 2007265961 | A | 10/2007 |
| JP | 2011060450 | A2 | 3/2011 |
| JP | 2012064551 | A2 | 3/2012 |
| JP | 2015002027 | A2 | 6/2013 |
| JP | 2015002028 | A2 | 1/2015 |
| JP | 2017107699 | A2 | 6/2017 |
| KR | 1020110008796 | A | 1/2011 |
| KR | 1020120061625 | A | 6/2012 |
| MX | 2011002947 | A | 9/2011 |
| TW | 474382 | U | 1/2002 |
| WO | WO 2013/128896 | A1 | 9/2013 |
| WO | WO 2015/000212 | A1 | 1/2015 |
| WO | WO 2016152166 | A2 | 8/2016 |

OTHER PUBLICATIONS

Final Office Action, dated Jul. 26, 2017, U.S. Appl. No. 14/184,601.
Non-Final Office Action (dated Oct. 16, 2014), U.S. Appl. No. 13/484,901, filed May 31, 2012, First Named Inventor: Michael D. Danesh, 15 pages.
Final Office Action (dated Apr. 2, 2015), U.S. Appl. No. 13/484,901, filed May 31, 2012, First Named Inventor: Michael D. Danesh, 13 pages.
Non-Final Office Action (dated Jun. 2, 2015), U.S. Appl. No. 12/183,424, filed Feb. 14, 2014, First Named Inventor: Michael D. Danesh, 20 pages.
Non-Final Office Action (dated Jul. 20, 2015), U.S. Appl. No. 14/184,601, filed Feb. 19, 2014, First Named Inventor: Michael D. Danesh, 19 pages.
Non-Final Office Action (dated Sep. 15, 2015), U.S. Appl. No. 13/484,901, filed May 31, 2012. First Named Inventor: Michael D. Danesh, 16.
"CA Office Action (dated Dec. 23, 2013), Application No. 2,778,581, Date Filed—Jun. 1, 2012", 3 pages.
DMF, INC., "dmfLighting: LED Recessed Lighting Solutions", *Info sheets*, (Mar. 19, 2012), 4 pages.
Halo, *Halo LED H4 H7 Collection, SustainabLEDesign, Cooper Lighting*, (emphasis on p. 18 "H7 Collection LED Modules—Halo LED H7 Module Features"), (Mar. 28, 2012), 52 pages.
Halo, *H7 LED Downlight Trims 49x Series, 6-inch LED Trims for Use with ML7x LED Modules, Cooper Lighting*, ADV110422, (rev. Aug. 12, 2011), 15 pages.
HALO, *LED Module ML706x, Cooper Lighting*, General Installation for All Modules/p. 1; Tether Installation/pp. 2-3; Installation into HALO H750x Series LED-only (Non-Screw based) Recessed Fixture/p. 4, (Oct. 20, 2009), 4 pages.
CA Office Action (dated Feb. 1, 2016), Application No. 2,879,486, Filing Date: Jan. 23, 2015, First Named Inventor: Michael D. Danesh, 5.
Final Office Action (dated Apr. 27, 2016), U.S. Appl. No. 14/184,601, Filing Date: Feb. 19, 2014, First Named Inventor: Michael D. Danesh, 18.
Final Office Action (dated Jun. 23, 2016), U.S. Appl. No. 13/484,901, filed May 31, 2012, First Named Inventor: Michael D. Danesh, 18 pages.
"*DME Series Installation Instructions*", (Oct. 18, 2011).
Final Office Action (dated Jan. 29, 2016), U.S. Appl. No. 14/183,424, filed Feb. 18, 2014, First Named Inventor: Michael D. Danesh, 21.
U.S. Appl. No. 29/645,941, filed Apr. 30, 2018, Danesh et al.
Acrich COB Zhaga Module, Product Description, Seoul Semiconductor, Nov. 2016, 39 pages.
<https://www.zhagastandard.org/books/book18/>, Mar. 2017, 5 pages.
Non-Final Office Action dated May 16, 2018 for U.S. Appl. No. 15/132,875, 18 pages.
Notice of Allowance dated May 10, 2018 from U.S. Appl. No. 14/726,064, 7 pages.
Non-Final Office Action, dated Dec. 15, 2016, U.S. Appl. No. 14/184,601.
Canadian Office Action, dated Dec. 6, 2016, Canadian Application No. 2,879,629.
U.S. Appl. No. 15/637,742, filed Jun. 29, 2017, Kopitzke, IV.
U.S. Appl. No. 15/688,266, filed Aug. 28, 2017, Gaskarimahalle.
U.S. Appl. No. 15/853,400, filed Dec. 22, 2017, Kashani.
U.S. Appl. No. 15/901,738, filed Feb. 21, 2018, Danesh.
U.S. Appl. No. 15/947,065, filed Apr. 6, 2018, Danesh.
U.S. Appl. No. 29/638,259, filed Feb. 26, 2018, Danesh.
U.S. Appl. No. 29/541,565, filed Oct. 5, 2015, Peng.
"Membrane Penetrations in Fire-Resistance Rated Walls," https://www.ul.com/wp-content/uploads/2014/04/ul_MembranePenetrations.pdf, Issue 1, 2009, 2 pages.

(56) References Cited

OTHER PUBLICATIONS

"Metallic and Non-metallic Outlet Boxes Used in Fire-rated Assembly," https://iaeimagazine.org/magazine/2000/09/16/metallic-and-non-metallic-outlet-boxes-used-in-fire-rated-assembly/, Sep. 16, 2000, 5 pages.
"Metallic Outlet Boxes," UL 514A, Underwriters Laboratories, Inc., Feb. 16, 2004 (Title Page Reprinted Aug. 10, 2007), 106 pages.
"Outlet Boxes for Use in Fire Rated Assemblies," https://www.ul.com/wp-content/uploads/2014/04/Ul_outletboxes.pdf, 2011, 2 pages.
2006 International Building Code, Section 712 Penetrations, 2006, 4 pages.
BXUV.GuideInfo, Fire Resistance Ratings—ANSI/UL 263, UL Online Certifications Directory, last updated Nov. 3, 2016, 27 pages.
Canadian Office Action dated Aug. 11, 2017 from Canadian Application No. 2,941,051, 4 pages.
Canadian Office Action dated Jun. 12, 2017 from Canadian Application No. 2,927,601, 4 pages.
Canadian Office Action dated Mar. 22, 2016 from Canadian Application No. 2,879,629, 4 pages.
Canadian Office Action dated Mar. 9, 2017 from Canadian Application No. 2,931,588, 5 pages.
CEYY.GuideInfo, Outlet Boxes and Fittings Certified for Fire Resistance, UL Online Certifications Directory, last updated May 16, 2013, 2 pages.
DMF, Inc., "dmfLIGHTING: LED Recessed Downlighting," DRD2 Product Brochure, Oct. 23, 2014, 50 pages.
DMF, Inc., "dmfLIGHTING: Led Recessed Downlighting," Product Catalog, Aug. 2012, 68 pages.
Final Office Action dated Jul. 26, 2017 from U.S. Appl. No. 14/184,601, 18 pages.
Non-Final Office Action dated Apr. 12, 2018 for U.S. Appl. No. 29/638,259, 5 pages.
Non-Final Office Action dated Apr. 30, 2010 from U.S. Appl. No. 12/173,232, 13 pages.
Non-Final Office Action dated Feb. 6, 2018 from U.S. Appl. No. 15/167,682, 9 pages.
Non-Final Office Action dated Mar. 15, 2010 from U.S. Appl. No. 12/100,148, 8 pages.
Non-Final Office Action dated Sep. 5, 2014 from U.S. Appl. No. 13/791,087, 8 pages.
Non-Final Office Action dated Sep. 6, 2017 from U.S. Appl. No. 14/726,064, 8 pages.
Notice of Allowance dated Aug. 23, 2017 from Canadian Application No. 2,879,629, 1 page.
Notice of Allowance dated Jan. 16, 2015 from U.S. Appl. No. 29/467,026, 9 pages.
Notice of Allowance dated Jan. 30, 2015 from U.S. Appl. No. 13/791,087, 9 pages.
Notice of Allowance dated Mar. 24, 2016 from U.S. Appl. No. 14/247,149, 8 pages.
Notice of Allowance dated Mar. 26, 2018 for U.S. Appl. No. 14/184,601, 10 pages.
Notice of Allowance dated Oct. 21, 2016 from U.S. Appl. No. 13/484,901, 7 pages.
"Advanced LED Solutions," Imtra Marine Lighting. 2011. 39 pages.
"Cree LMH2 LED Module with TrueWhite Technology," Cree Product Family Data Sheet. 2011. 3 pages.
"Cree LMH2 LED Modules Design Guide," Cree Product Design Guide. 2011. 20 pages.
"Cree LMH2 LED Modules," Mouser Electronics. 2 pages.
"LED Undercabinet Pocket Guide," ELCO Lighting.12 pages.
"Portland Bi-Color, Warm White/Red," item:ILIM30941.Imtra Marine Products. 2012. 3 pages.
"Undercabinet Pucks, Xyris Mini LED Puck Light," ELCO Lighting. Sep. 2018. 1 page.
"VERSI LED Mini Flush," Lithonia Lghting. 6 pages.
4" Octagon Concrete Boxes and Back Plates. Appleton. Accessed at www.appletonelec.com on May 6, 2019. 1 page.
Civil Action No. 2:18-cv-07090. Complaint for Infringement and Unfair Competition. *DMF, Inc.* v. *AMP Plus, Inc. d/b/a Elco Lighting.* 52 pages. Dated Aug. 15, 2018.
Cree LED Lamp Family Sales Sheet—Better light is beautiful light , Apr. 24, 2017, 2 pages.
CS&E PCT Collaborative Search and Examination Pilot Upload Peer Contribution in International Patent Application No. PCT/US18/62868 dated Mar. 14, 2019, 61 pages.
CS&E PCT Collaborative Search and Examination Pilot Upload Peer Contribution in International Patent Application No. PCT/US18/67614 dated Apr. 24, 2019, 53 pages.
Final Office Action dated Mar. 15, 2019 from U.S. Appl. No. 15/132,875,15 pages.
Imtra Marine Lighting 2008 Catalog. 40 pages.
Imtra Marine Lighting 2009 Catalog. 32 pages.
Imtra Marine Lighting Spring 2007 Catalog. 36 pages.
International Search Report and Written Opinion in International Patent Application No. PCT/US18/39048 dated Dec. 14, 2018. 24 pages.
International Search Report and Written Opinion in International Patent Application No. PCT/US18/62868 dated Mar. 14, 2019, 13 pages.
International Search Report and Written Opinion in International Patent Application No. PCT/US18/67614 dated Apr. 25, 2019, 20 pages.
International Search Report and Written Opinion in PCT/US2018/048357 dated Nov. 14, 2018, 13 pages.
Non-Final Office Action dated Apr. 4, 2019 from U.S. Appl. No. 29/678,482, 8 pages.
Non-Final Office Action dated Dec. 5, 2018 from U.S. Appl. No. 14/942,937, 13 pages.
Non-Final Office Action dated Feb. 7, 2019 from U.S. Appl. No. 16/200,393, 32 pages.
Non-Final Office Action dated Jul. 24, 2018 from U.S. Appl. No. 29/638,259, 5 pages.
Non-Final Office Action dated Jun. 25, 2018 for U.S. Appl. No. 29/541,565, 10 pages.
Non-Final Office Action dated Oct. 24, 2018 for U.S. Appl. No. 15/688,266, 14 pages.
Notice of Allowance dated Apr. 1, 2019 from U.S. Appl. No. 15/167,682, 7 pages.
Notice of Allowance dated Apr. 17, 2019 from U.S. Appl. No. 29/678,478, 7 pages.
Notice of Allowance dated Apr. 8, 2019 from U.S. Appl. No. 29/653,142, 8 pages.
Notice of Allowance dated Feb. 8, 2019 from U.S. Appl. No. 29/541,565, 5 pages.
Notice of Allowance dated Jan. 2, 2019 from U.S. Appl. No. 29/541,565, 6 pages.
Notice of Allowance dated Jan. 28, 2019 from U.S. Appl. No. 29/664,471, 8 pages.
Notice of Allowance dated May 22, 2018 from U.S. Appl. No. 14/183,424, 9 pages.
Notice of Allowance dated Nov. 27, 2018 from U.S. Appl. No. 15/167,682, 11 pages.
Notice of Allowance dated Oct. 4, 2018 from U.S. Appl. No. 15/947,065 , 9 pages.
Notice of Allowance dated Oct. 9, 2018 from U.S. Appl. No. 29/653,142, 7 pages.
Notice of Allowance dated Sep. 19, 2018 from U.S. Appl. No. 15/167,682 , 7 pages.
Notice of Allowance dated Sep. 21, 2018 from U.S. Appl. No. 29/645,941, 5 pages.
OneFrame Recessed LED Downlight. Dmflighting.com. Published Jun. 6, 2018. Retrieved at https://www.dmflighting.com/productioneframe on Jun. 6, 2018. 11 pages.
RACO 4 in. Octagon Welded Concrete Ring, 3-1/2 in. Deep with 1/2 and 3/4 in. Knockouts and ilcludes 890 cover (20-Pack). Model # 280. Accessed at https://www.homedepot.com/p/RACO-4-in-Octagon-Welded-Concrete-Ring-3-1-2-in-Deep-with-1-2-and-3-4-in-Knockouts-and-ilcludes-890-cover-20-Pack-280/203638679 on Jan. 18, 2019. 3 pages.

(56) References Cited

OTHER PUBLICATIONS

RACO 4 in. Octagon Welded Concrete Ring, 6 in. Deep with 1/2 and 3/4 in. Knockouts (10-Pack). Model # 276. Accessed at https://www.homedepot.com/p/RACO-4-in-Octagon-Welded-Concrete-Ring-6-in-Deep-with-1-2-and-3-4-in-Knockouts-10-Pack-276/203638675 on Jan. 16, 2019. 4 pages.
RACO Commercial, Industrial and Residential Electrical Products. Hubbell. Accessed at www.Hubbell-RTB.com on May 6, 2019. 356 pages.
Specification & Features 4" Octagonal Concrete Box Covers. Orbit Industries, Inc. Accessed at https://www.orbitelectric.com on May 6, 2019. 1 page.

* cited by examiner

Sectional view along B - B'

RECESSED LIGHTING ASSEMBLY

FIELD

An embodiment of the invention relates to a recessed lighting assembly that has a fire resistant casing, a light source module that is held inside the casing, and a trim attached to the casing. Other embodiments are also described.

BACKGROUND

Recessed lighting units are typically installed or mounted into an opening in a ceiling or a wall. Modern recessed lighting units generally consist of a trim, a light source module, a driver circuit, a legacy incandescent "can" in which the light source module and driver circuit are housed, a junction box, and a set of hangar bars to which a horizontally oriented frame or platform is directly attached. The can and junction box are attached to the horizontally oriented platform. The combination of the can and junction box attached to the horizontal platform is bulky and expensive to manufacture.

SUMMARY

An embodiment of the invention is a recessed lighting unit that advantageously obviates the need for a separate junction box that is dedicated to the recessed lighting unit, because the building electrical power network wires, that supply power to another nearby recessed lighting unit or that come from a nearby shared wire enclosure or junction box, are routed directly into the casing of the recessed lighting unit (for supplying power to a light source module inside the casing.) A further advantageous aspect is that the light source module (to which a trim has been attached, e.g., via a twist and lock mechanism) is positioned deeper inside a casing of the recessed lighting unit, thereby yielding improvements in the illumination provided by the module. The casing has a closed top end, and a side wall having a top edge which joins the closed top end, wherein the side wall extends downward from the closed top end and is curved so as to completely surround a cavity that is between the closed top end and an open bottom end of the casing that is defined by a bottom edge of the sidewall. The trim may be composed of a crown that has a frusto-conical shape, wherein the crown has a base with a base opening formed therein, and a top with a top opening formed therein. Light to be emitted from the module is to pass through the crown by passing through the top opening and then through the base opening before illuminating a room. A frustum extends from the base of the crown to its top. The trim also has a brim that is attached to the base and encircles the base opening. The brim will sit flush against a ceiling or wall behind which the casing is installed, e.g., attached to structural beam member of the building. To attach the trim to the light source module, a means is used for attaching the top of the crown to the light source module. The module is held in its deeper position inside the casing, by a means that is anchored to the frustum of the crown and that is for attaching to the sidewall of the casing. The crown is dimensioned to be tall enough such that when the light source module is attached to the top of the crown, the light source module is held entirely within the cavity of the casing (when the means anchored to the frustum of the crown is attached to the sidewall of the casing.)

In one embodiment, a holding bracket is provided that can slide vertically within the cavity of the casing. The bracket has two or more arms that extend upward from a frame, where each arm has a slot formed lengthwise in it and through which an attaching member extends; the attaching member is fixed to the sidewall of the casing, so that the arms can slide up and down while being guided by the attaching member through the slot. The light source module is attached to the frame of the bracket. The light source module receives electrical power from the building electrical system through high voltage wires that go into the casing and connect to the module; the bracket prevents the light source module from hanging only by these high voltage wires, in the event that the mechanism for attaching the trim to the sidewall of the casing becomes accidentally overloaded (thereby causing the trim and the attached light source module to fall out of the casing, where the casing is mounted behind a ceiling, under the pull of gravity). Also, the bracket may be designed to be short enough, e.g., its arms are short enough, to ensure that in its lowest position, the attached light source module does not hang so far below the casing as to freely give a user access to the high voltage wires inside the casing; with the bracket in its lowest position, the user should have to first detach the light source module from the bracket before being able to disconnect or connect the high voltage wires.

The bracket may be free to slide vertically downward, until a stop is reached which prevents the bracket from falling out of the casing (under the pull of gravity). The bracket may also be free to slide vertically upward; this enables the light source module, which is attached to the bracket, to be vertically moved upward into any desired recessed position inside the casing, e.g., by a user grasping and pushing the trim (to which the light source module is also attached) upward in the vertical direction, until the upper surface of the brim (of the trim) abuts a lower surface of the ceiling (a stop is reached.) In this manner, the holding bracket also allows trims of different depth (height) to be attached to the same light source module, while still being able to be positioned all the way up and flush against the ceiling.

The design of the recessed lighting unit can also easily accommodate irregularity in the thickness of the ceiling of a building, where some portions have greater thickness than others. The light source module is attached to the trim, but is other wise free to be pushed deeper into the casing as needed to accommodate a thicker ceiling condition. The mechanism for attaching the trim to the sidewall of the casing may include friction clips that are anchored to the crown portion of the trim; the friction clips are sufficiently strong to stay fixed in position against the sidewall of the casing despite the added weight of the light source module. By also providing a fire resistant casing, the recessed lighting unit eliminates the added bulk and size of traditional recessed lighting units that have a separate outer enclosure or fire box around the incandescent can.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment. In other words, there may be elements shown in a given figure that are optional, or unnecessary, for certain embodiments.

DETAILED DESCRIPTION

Several embodiments of the invention with reference to the appended drawings are now explained. Whenever the shapes, relative positions and other aspects of the parts described in the embodiments are not explicitly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1A:
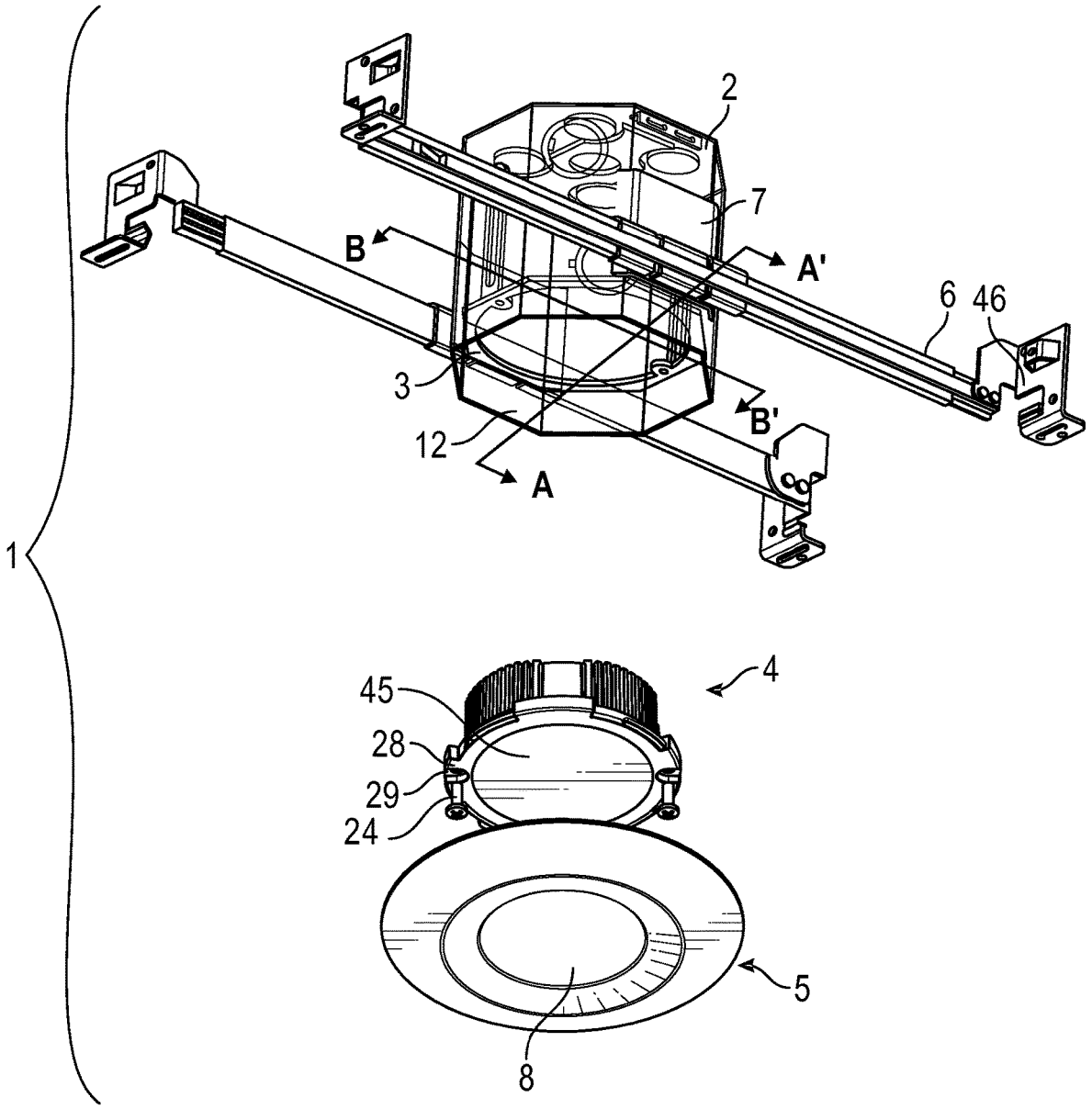
FIG. 1A shows a perspective view of a recessed lighting unit according to one embodiment.

FIG. 1A shows a perspective view of an embodiment of a recessed lighting unit 1, which may be installed within a wall or a ceiling. The recessed lighting unit 1 may include a casing 2, a holding bracket 3 (which may also be referred as a yoke) inside the casing 2, a light source module 4 inside the casing 2, a trim 5, hangar bars 6, and casing holders 7. The recessed lighting unit 1 is positioned behind a ceiling or a wall so that the casing 2 is aligned with a hole in the ceiling or wall (not shown) through which the room is illuminated by the module 4. The light source module 4 as will be described below in more detail is contained inside the casing 2. The trim 5 serves the primary purpose of covering the exposed edge of the ceiling or wall where the recessed lighting unit 1 resides and where the hole is formed, while still allowing light from the light source module 4 to be emitted into a room through a trim opening 8. The trim 5 may also serve to hide the bottom edge of the casing 2 from view. In doing so, the trim 5 helps the recessed lighting unit 1 appear seamlessly integrated into the ceiling or wall. The trim 5 is attached to the light source module 4 (e.g., via a twist and lock mechanism, for example, or a snap fit mechanism), and also directly to the casing 2 (e.g. via friction clips, tension clips (tension grips), or magnets). The section views of the recessed lighting unit in FIG. 2 and FIG. 3 show the assembly with the trim 5 attached to the light source module 4, where a top of the crown 38 of the trim 5 is abutting the front surface of a lens 45, where the latter has been fitted into position covering the bottom opening of the housing of the module 4.

The casing 2 of the present invention is advantageous in that it is compact, cost-effective, and fire resistant. The casing 2 obviates the need for a traditional junction box attached to an incandescent "can," which may be bulky and expensive. The casing 2 may be made of galvanized steel, injection molded plastic, or ceramic, which is also advantageous over the traditional, non-fire resistant incandescent can. The casing 2 may be fire-resistant in that it has a fire rating of up to two hours without any need for modification, where the fire rating is described in the National Electrical Code (NEC) and by the Underwriters Laboratories (UL) such as specified in UL 263 Standard for Fire Tests of Building Construction and Materials. The fixture may also be designed to attenuate airborne sound by the building partition (ceiling) in which it is installed; in one embodiment, the casing 2 can maintain a minimum Sound Transmission Class (STC) rating of 50; this alleviates the need for enclosing the casing 2 with any additional element in order to maintain a minimum 50 STC rating.

Figure 2:
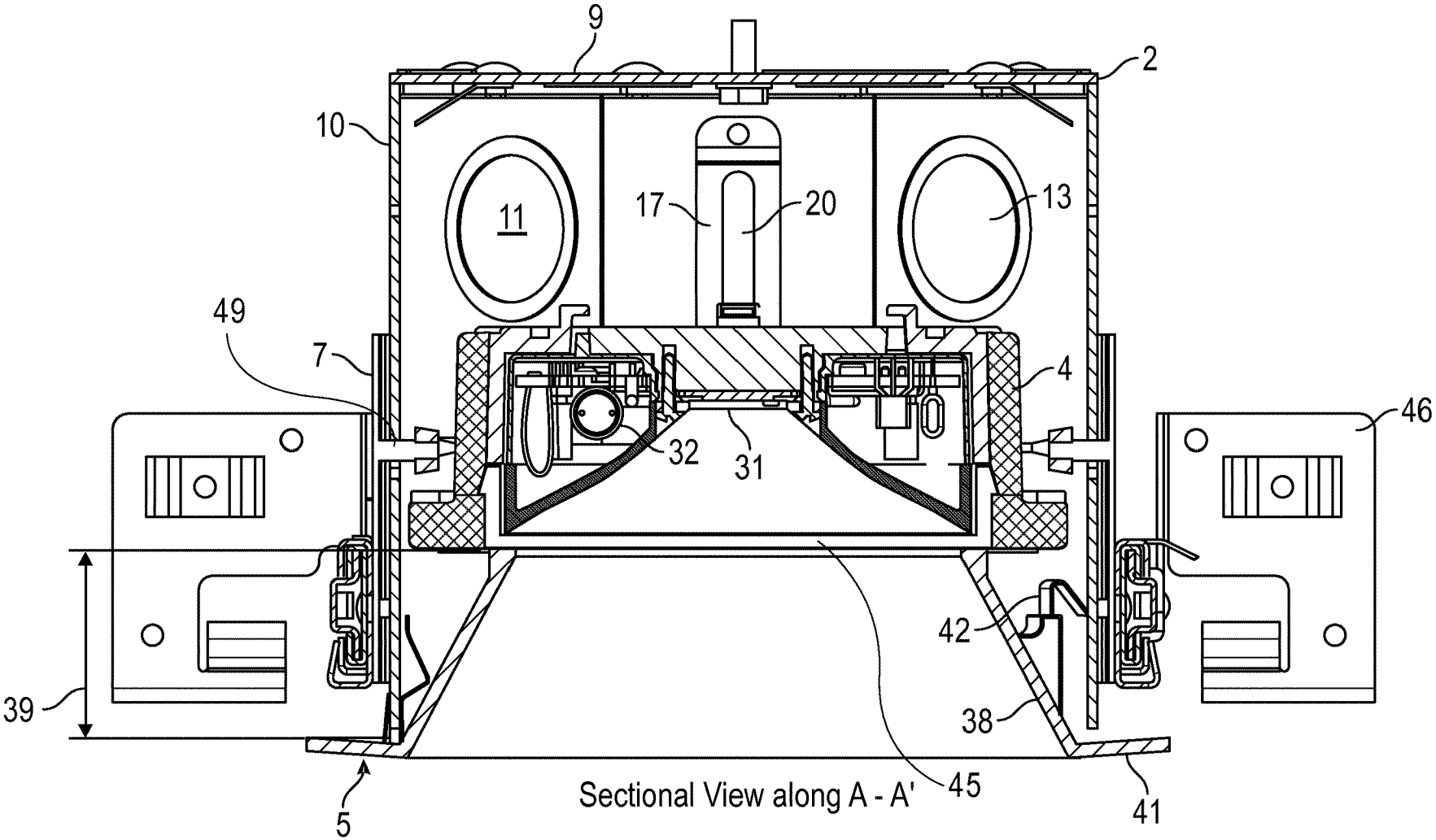
FIG. 2 shows a side cross section view of the embodiment of FIG. 1A along the cut A-A'.
Figure 3:
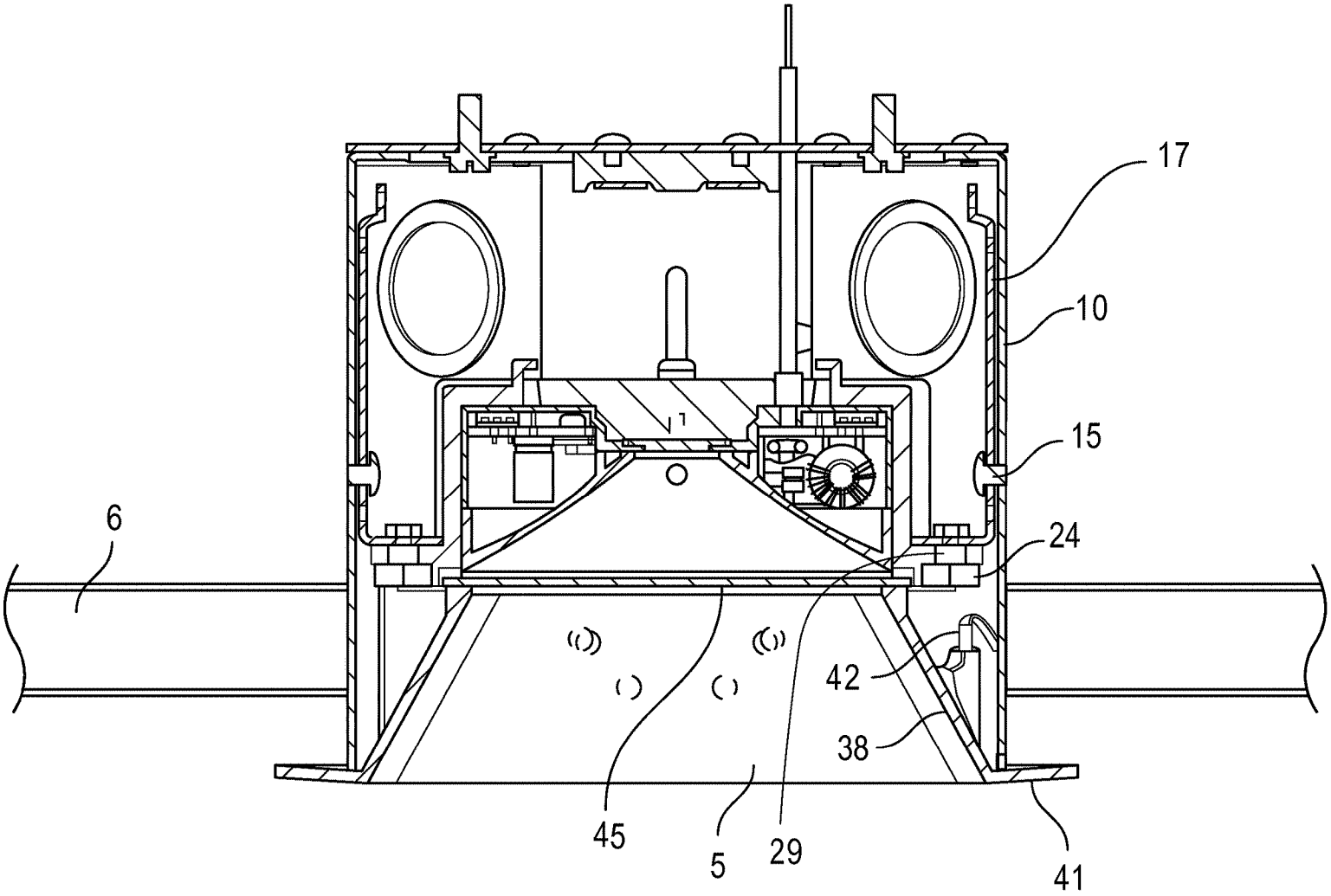
FIG. 3 shows a front cross section view of the embodiment of FIG. 1A along the cut B-B'.

In one embodiment, as shown in the section view of FIG. 2, the casing 2 may have a closed top end 9, and a side wall 10 that surrounds a cavity 11 and defines a bottom end opening 12. The closed top end 9 and the sidewall 10 may have one or more knockouts 13. A knockout 13 may be punched through and removed to leave an opening in the closed top end 9 or the side wall 10, for building electrical power wires (e.g. non-metallic sheathed cable, or to receive metal flexible conduit) to be inserted through the opening. A knockout 13 may also have a smaller opening in it (e.g., a slit, slot, etc., that is smaller than the opening that results when the knockout 13 has been removed from the closed top end 9 or the side wall 10) that may allow the installer to pry-out the knockout with a flathead screwdriver. The knockout 13 may be more than ½ inch in its smallest diameter (as its shape may be elliptical as shown, having a minor diameter and a major diameter). The casing 2 may have a horizontal cross section that is shaped as a polygon. For example, the horizontal cross section of the casing 2 may be square, rectangle, pentagon, hexagon, heptagon, octagon, nonagon, or decagon. The casing 2 may be made from a flat sheet of metal that is folded into a polygonal cylinder to form the sidewall 10. The casing 2 may also be ellipsoid, frusto-conical, or otherwise curved.

Figure 1B:
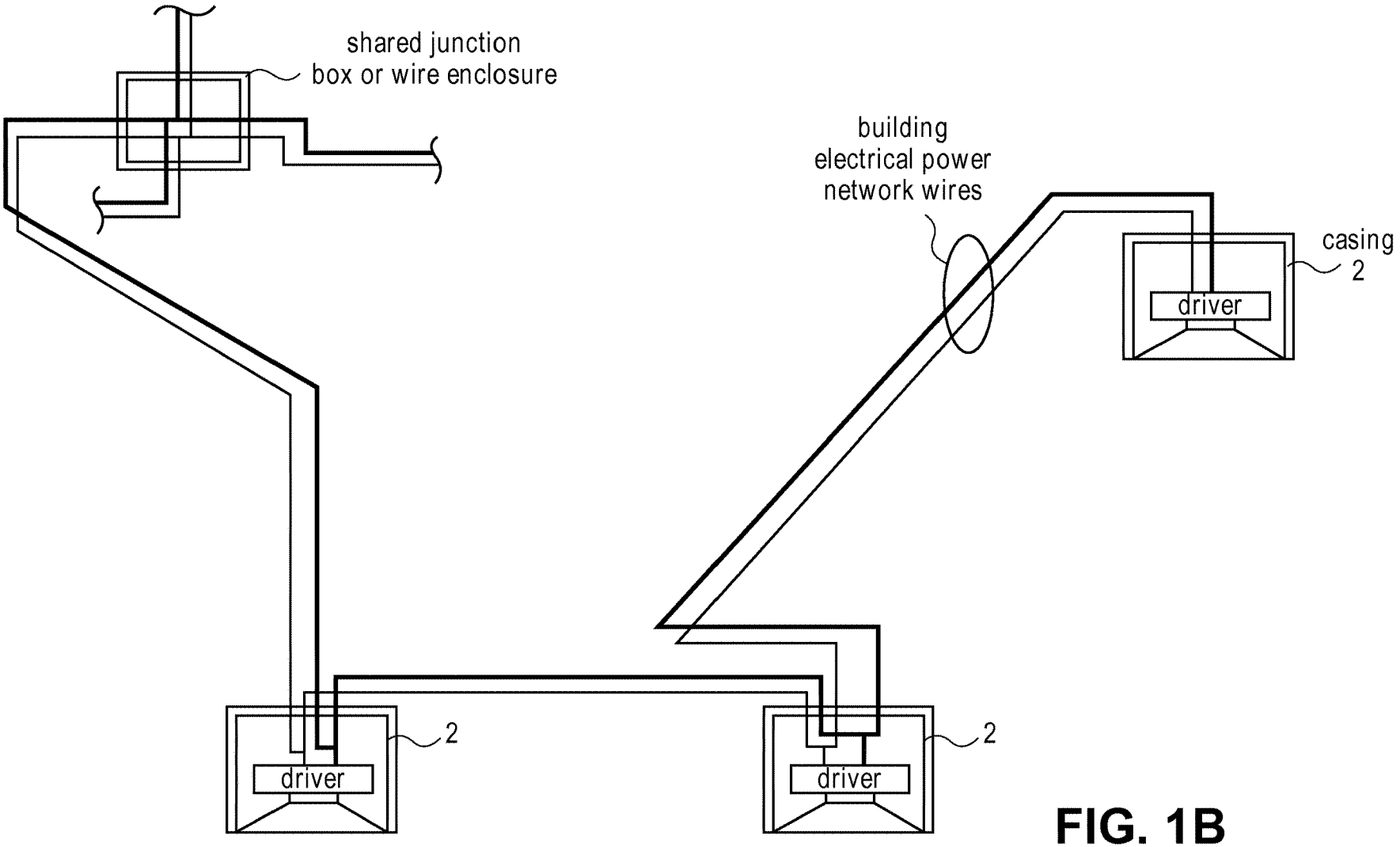
FIG. 1B depicts part an illumination network in which several of the recessed light units are connected directly without the use of dedicated junction boxes.

Held inside the light source cavity 11 is the light source module 4, which has a housing in which a light source 31 and a driver 32 are installed. The building electrical power wires that are routed into the casing 2 are connected to a set of driver wires that merge from the module 4, within the cavity 11. These electrical wires may be connected together through the use of interlocking connectors that may be contained within the cavity 11 of the casing 2. In other embodiments, the electrical wires may be coupled to each other through the use of electrical caps or other devices (inside the cavity 11 of the casing 2). When the wires are connected, electricity may pass from the building electrical power wiring network to the driver 32 to enable the driver 32 to power the light source 31 (and thereby illuminate the room). In one embodiment, where there is a network of such recessed lighting units 1 installed within a building, as depicted in FIG. 1B, the electrical wires that come into the casing 2 (through the knockout 13 for example) can be routed directly from their "adjacent" connection at another recessed lighting unit 2 (that may be installed behind the same ceiling or wall, or a nearby one in the same building.) In other words, the building electrical wires coming into the casing 2 (to supply power to operate the light source module) can be directly routed from the inside of another, nearby recessed lighting unit or from a shared junction box as shown in FIG. 1B. In other words, the casing 2 has two or more driver wires 33 that emerge from the light source module 4 (see FIG. 4) and that are electrically connected to the two or more building electrical power wires, respectively, inside the cavity 11 of the casing 2. This obviates the need to add a separate junction box to make such a connection, in part because the casing 2 is also fire-rated to be a protective housing for the connection between i) the driver wires that emerge from or terminate in the driver 32 and ii) the building wires that come into the casing 2 and that are directly connected to power another recessed lighting unit in the same building.

The driver 32 is an electronic circuit or device that supplies and/or regulates electrical energy to the light source 31 and thus powers the light source 31 to emit light. The driver 32 may be any type of power supply circuit, including one that delivers an alternating current (AC) or a direct current (DC) voltage to the light source 31. Upon receiving electricity, the driver 32 may regulate current or voltage to supply a stable voltage or current within the operating parameters of the light source 31. The driver 32 receives an input current from the building electrical power wiring network of the building or structure in which the recessed lighting unit 1 is installed, and may drop the voltage of the input current to an acceptable level for the light source 31 (e.g., from 120V-277V to 36V-48V).

The light source 31 may be any electro-optical device or combination of devices for emitting light. For example, the light source 31 may have one or more light emitting diodes (LEDs), organic light-emitting diode (OLEDs), or polymer light-emitting diode (PLEDs). The light source 31 receives electricity from the driver 32, as described above, such that the light source 31 can emit a controlled beam of light into a room or surrounding area of the recessed lighting unit 1 (as installed behind a ceiling or wall).

In one embodiment, the light source module 4 may also include a lens 45. The lens 45 may be formed to converge or diverge, or simply filter, the light emitted by the light source 31. The lens 45 may be a simple lens comprised of a single optical element or a compound lens comprised of an array of simple lenses (elements) with a common axis. In one embodiment, the lens 45 also provides a protective barrier for the light source 31 and shields the light source 31 from moisture or inclement weather. The lens 45 may be made of any at least partially transparent material, including glass and hard plastics, and may be sized and shaped to be snap fitted into position covering the main opening at the bottom of the module 4 as shown. In one embodiment, the lens 45, the light source 31, and the driver 32 are contained in a single indivisible unit, the light source module 4, to work in conjunction to focus and adjust light emitted by the light source 31.

The light source module 4 may, or may not, be attached to a trim 5. The trim 5 has a crown 38 (as seen in FIG. 2 and FIG. 3), also referred to here as an annular region, whose central opening 8 allows light from the light source module 4 to pass through and illuminate the room or environment beyond the wall or ceiling. A brim 41 may surround the base of the crown 38, serving to hide or cover an edge of the wall or ceiling in which a hole for emitting light into the room is formed. Although not shown, that edge may surround the sidewall of the casing 2 (once the lighting unit 1 has been installed.) The crown 38 may be frusto-conical around the opening 8, and its height (crown height 39) may be in the range of 1 inch to 2.5 inches measured vertically from a top surface of the brim 41 (that may abut the ceiling or wall) to a top of the crown 38. This may define the height of the trim 5; as mentioned above, trims of different height that are designed to be attached to the same light source module 4 and to the casing 2 can be used (interchangeably).

In one embodiment, the crown 38 may be pushed deep into the casing 2 so that the brim 41 comes into contact with (abuts or is flush against) the edge of the sidewall that defines the bottom opening 12 of the casing 2. In another embodiment, where the edge of the casing 2 might not be aligned flush with the bottom surface of the wall or ceiling (e.g., where the bottom opening 12 of the casing 2 lies above or behind of the wall or ceiling), the crown 38 is pushed into the casing 2 but cannot be as deep, even though the brim 41 is still flush with the wall or ceiling.

Figure 4:
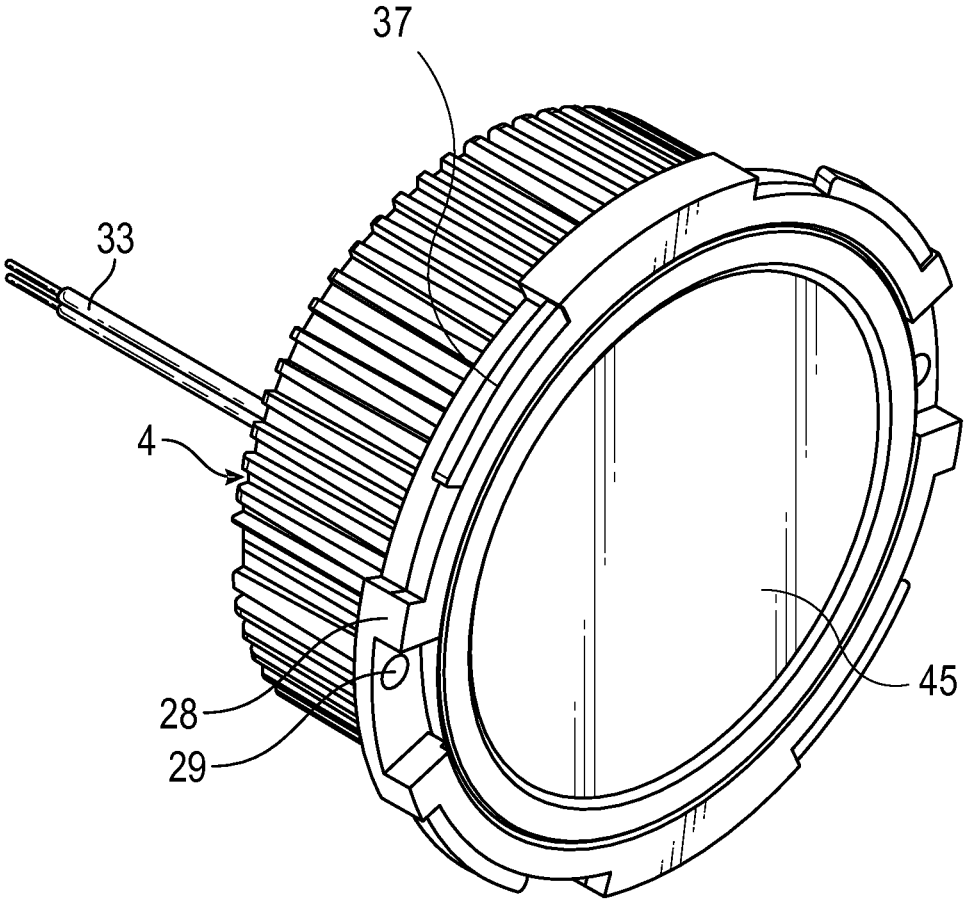
FIG. 4 shows a perspective view of a light source module.

In one embodiment, referring now to FIG. 4, the light source module 4 as shown therein may be rigidly attached to the trim 5 via a twist and lock mechanism. One half of the twist and lock mechanism being a bump or a hook that is formed at the top (of the crown 38) of the trim 5, while the other half is a tapered portion 37 that is formed on a lip 28 of the light source module 4; the user rotates the trim 5 and the module 4 relative to each other until the bump or hook of the trim 5 is aligned with the slot that is formed in the lip 28 next to the tapered portion 37 and then pushes the two parts towards each other while "twisting" so that the bump or hook and the tapered portion 37 engage each other until they are "locked" through friction. This provides a tool-free way to couple the trim 5 to the light source module 4. Other suitable means for attaching the top of the crown 38 to the light source module 4 may be possible, including a threaded fastener (e.g., screw, or a nut and bolt combination), a snap fit mechanism, a clip, an adhesive, and clamp that clamp the lip 28 to a flat top surface of the crown 38.

Returning to FIGS. 1A, 2, 3, once the trim 5 is attached to the light source module 4, and the electrical connection between the driver wires and the building wires inside the casing 2 has been made, the assembly of the light source module 4 and the trim 5 may be pushed upwards or inward into the cavity of the casing 2, through the hole in the ceiling or wall, until the brim 41 sits flush against the ceiling or wall. This may complete the installation of the recessed lighting unit 1.

Any suitable means for attaching the assembly of the light source module 4 and trim 5 to the sidewall of the casing can be used, in order to hold the trim 5 flush against the ceiling or wall. In one embodiment, as seen in the section view of FIG. 2, one or more friction clip 42 may be utilized to secure the assembly to the casing 2, which also allows the trim 5 to slide upward along the sidewall of the casing 2 as it is pushed by the user, to eventually lie flush against the ceiling or wall. As shown in the embodiment of FIG. 2, the friction clip 42 may be attached at its anchored end (via screw, bolt, resin, glue, or the like) to the crown 38 of the trim 5, while at their flexible or resilient end they will engage the sidewall of the housing 2. Alternatively, the friction clip 42 may be anchored to the light source module 4, or to a frame 18 of the holding bracket 3 as described below. As seen in the embodiment of FIG. 2, the friction clip 42 may be composed of a generally V-shaped piece (e.g., of metal) that is oriented upside down as shown, with one segment of the V being anchored to the top surface of the frustum of the crown 38 (the bottom surface of the crown serving to reflect the light emitted from the module 4 into the room) while the other segment of the V comes into direct frictional contact with the inner surface of the sidewall 10 of the casing 2. The stiffness (when squeezing the two segments of the V towards each other) of the clip 42 provides sufficient friction that overcomes the combined weight of the light source module 4 and the trim 5, thereby preventing the assembly from falling out of the casing 2 (e.g. under the force of gravity.) Other means for attaching the light source module-trim assembly to the casing 2 include the use of one or more magnets that may be fixed on the trim 5, or on the light source module 4, and that are attracted to the casing 2 through magnetic force to hold the assembly in the casing 2, while still allowing the assembly to be slid upwards by the user (until the trim lies flush against the ceiling.)

Figure 6:
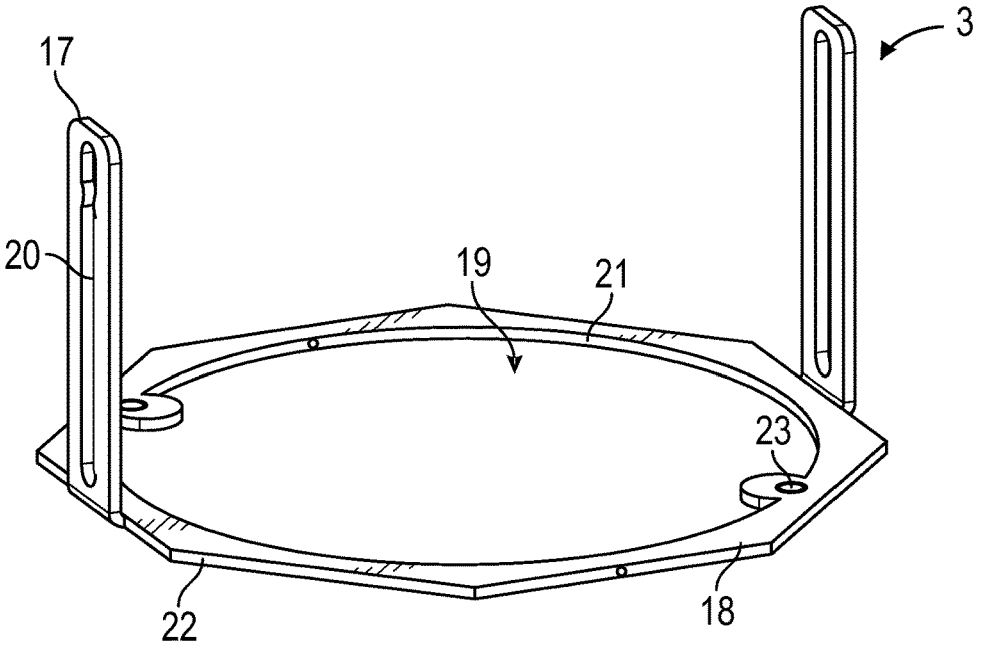
FIG. 6 shows a perspective view of a holding bracket.

Also shown in FIGS. 1A and in the section view of FIG. 3 is another embodiment of the invention, where a holding bracket 3 is added inside the cavity of the casing 2. A perspective view of the holding bracket 3 is shown in FIG. 6. The holding bracket 3 may be a separate piece than the casing 2, and is coupled to an attaching member 15 that is fixed in position onto the sidewall 10. The bracket 3 may have one or more arms 17 that extend upward from a frame 18 that has a frame opening 19 therein. In a preferred embodiment, there are two arms 17 that extend upward from the frame 18, but additional arms 17 may be provided. The bracket 3 may be initially formed from a flat sheet of metal, with the frame 18 and the arms 17 formed on a same plane. Subsequently, the arms 17 may be cut out and then bent upward in the same direction. Each arm 17 may have a slot 20 running along its length through which a respective attaching member 15 may be fitted. The attaching member 15 may be a screw, bolt, pin, rivet or any other structure that is capable of coupling with the arm 17, by extending through the slot 20 and being fixed to the sidewall 10. While so engaged to the attaching member 15, the arm 17 of the bracket 3 is slidable within the cavity 11, relative to the attaching member 15 and along its slot 20. There may be some friction between the slot 20 and the attaching member 15 that may prevent the bracket 3 from freely sliding downward (under the force of gravity alone.) To maintain a desired, and optionally, adjustable, spacing between the arm 17 and the sidewall, the attaching member 15 may be threaded so as to receive a corresponding nut (not shown). In that condition, the arm 17 is held within a desired spacing between the nut and the sidewall 10 of the casing 2. In one instance, the nut is received on the end of the attaching member 15 that is located inside the casing 2.

The holding bracket 3 may also be described as having multiple arms extending upward from the frame 18, where the frame 18 has a border that encloses a frame opening 19 as shown. The slot 20 is elongated, and runs along a length dimension of its respective arm 17. The attaching member 15 extends from the sidewall 10 into the cavity 11 of the casing 2, while passing through the slot 20, and is sized so as to couple the arm 17 to the sidewall 10 constraining translation of the arm 17 in the lateral direction but allowing pivoting of the arm 17 about the attaching member 15. The arm 17 has a surface that is facing the sidewall 10 and that is flat from one end to another end that is joined to the border of the frame 18. The arm 17 is slidable along the sidewall 10 between its innermost position and its outermost position within the cavity, wherein the outermost position of the arm is reached when its sliding is stopped by the attaching member 15.

Note that use of the bracket 3 is optional. When the bracket 3 is used, its frame 18 may be attached to the light source module 4, before the trim 5 is attached to the module 4. The arms of the bracket 3 and the slots therein should be long enough to allow the bracket 3 to slide deeper into the cavity 11, as needed to raise the trim 5 so that the brim 41 can lie flush against the ceiling or wall.

In one embodiment, when the bracket 3 is at its innermost (or uppermost) position inside the cavity 11, the bottom of the frame 18 may be within the range of 1 inch to 2.5 inch above the bottom edge of the sidewall of the casing 2 (that defines the bottom end opening 12 of the casing 2.) In one embodiment, when the bracket 3 is at its outermost (or lowermost) position, the bottom of the frame 18 may be in the range of 0 inch to ½ inch below the bottom edge of the sidewall of the casing 2. Also, when the bracket 3 is at its outermost position, there may be some play allowing the bracket 3 to pivot laterally (when the attaching members 15 are up against the uppermost end of the slots 20.) The bracket 3 also functions to prevent the light source module 4 (and the attached trim 5) from falling out of the casing 2, when the bracket has reached its outermost position; the attaching member 15 in that condition acts as a stop against the sliding arm 17, by abutting an inner top end of the arm that is defined by the slot.

Figure 5:
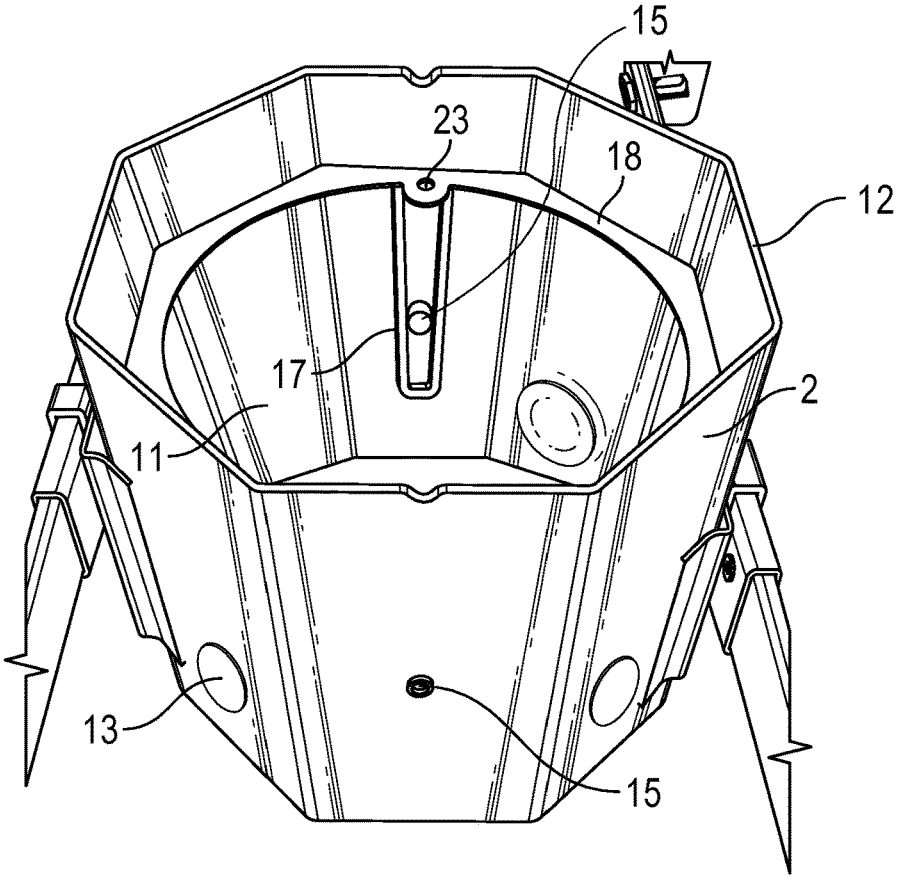
FIG. 5 shows a perspective looking into the cavity of the casing, through the opening.

As seen in FIG. 6, the frame 18 of the holding bracket 3 may have an inner edge 21 that is circular, oval, polygonal or curved. The frame 18 may have an outer edge 22 that is circular, oval, polygonal or curved. The outer edge 22 and the inner edge 21 may have different contours. In the embodiment shown in FIG. 5 for example, the outer edge 22 is polygonal while the inner edge 21 is circular. In a preferred embodiment, the outer edge 22 has the same number of sides as the casing 2, and the outer edge 22 conforms to the shape of the sidewall 10 of the casing 2. It is not necessary to have the outer edge 22 of the frame 18 that precisely conforms to the shape of the sidewall 10 of the casing 2. In one embodiment, the outer edge 22 may be oval or circular as long as the frame 18 fits inside the cavity 11 of the casing 2.

The frame 18 is attached to the light source module 4. As also seen in FIG. 3, the frame 18 may have an opening 23 that is configured to receive a corresponding attaching member 24, such as a screw, bolt, pin, or any other fastener piece that is capable of attaching the light source module 4 to the frame 18. As seen in FIG. 4, the light source module 4 may have a lip 28 that extends laterally outward from a base of the housing of the module 4, surrounding the base where the lens 45 is fitted (and from which light produced by the light source 31 emerges to illuminate the room below). One or more openings 29 may be formed on the lip 28 that correspond to and align with the openings 23 of the frame 18, when the housing of the module 4 has been inserted through the frame opening 19 of the frame 18, as depicted in FIG. 2. Once the bottom surface of the frame 18 abuts the top surface of the lip 28, a fastener (e.g., the attaching member 24 depicted in FIG. 1A), can be inserted through both openings and then can be fastened so as to secure the module 4 to the frame 18. In the embodiment shown in FIG. 6, there are two openings 23 formed in the frame 18 which correspond and align with to the two openings 29 that are formed in the lip 28 of the light source module 4 as seen in FIG. 4; the attachment of course can also be achieved at more than locations (with more than two fasteners).

In one embodiment, the recessed lighting unit 1 may include a set of hangar bars 6 as shown in FIG. 1 from which the casing 2 can be hung. The hangar bars 6 may be rigid, elongated members that are connected between adjacent joists and/or beams that are behind the walls or ceilings of the building (there may be two, positioned on opposite sides of the casing 2 as shown). In one embodiment, each of the hangar bars 6 may be telescoping such that the hangar bar 6 can be extended or retracted to meet the gap between the joists and/or beams.

In one embodiment, each of the hangar bars 6 may include mounting blocks 46 at its ends, which are the points at which the hangar bars 6 are attached to the joists and/or beams. For example, as shown in FIG. 1A, the mounting blocks 46 may include holes for receiving screws and/or nails or other fasteners that enable the hangar bars 6 to be securely attached to a building structure. Although shown in FIG. 1A and described above in relation to holes and screws, in other embodiments, other mechanisms of attachment may be used in conjunction with the mounting blocks 46, including resins, clips, or clamps to attached the bars 6 to the building structure. In one embodiment, a mounting block 46 may be integrated in one indivisible structure along with the hangar bar 6, while in other embodiments, as shown in FIG. 1A, the mounting blocks 46 may be coupled to the hangar bars 6 through the use of one or more attachment mechanisms (e.g., screws, bolts, resins, clips, or clamps). Using the telescoping and mounting features described above, the recessed lighting unit 1 may be installed in almost all of the typical 2"×2" through 2"×18" wood joist constructions, metal stud constructions, and t-bar ceiling constructions.

Still referring to FIG. 1A, in one embodiment, the recessed lighting unit 1 may have a mechanism for mounting the casing 2 to the hangar bars 6, that includes a set of casing holders 7 that couple the casing 2 to the hangar bars 6. As also seen in FIG. 2, the casing holder 7 may have a plate portion that conforms to the polygonal shape of the sidewall and is secured to the sidewall 10 of the casing 2 by a nut and bolt/screw combination 49; if a slot is also formed in the sidewall 10 through which bolt/screw of the combination 49 passes, then the height of the casing 2 becomes adjustable relative to the hangar bars 6. Alternatively, the casing holder 7 may be attached to the sidewall via a clip, a clamp, a weld, or an adhesive resin. The casing holder 7 may have another portion that is configured to wrap around but slide (or otherwise move) along the length of its corresponding, elongated hangar bar 6 (between the ends of the hangar bar 6.) The casing 2 may thus be moved along the hangar bars 6 to a desired location (e.g., at which the lens 45 of the light source module 4 will be directly above the opening in the ceiling or wall), and then it may be affixed to the hangar bars 6 once at the desired location, so that the casing holder 7 can no longer be moved relative to the hangar bars 6.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, as mentioned above, the light source module 4 need not be attached to the trim 5 (such as by a twist and lock mechanism or other attachment mechanism), if the module 4 is attached to the holding bracket 3; in that case, the module 4 can simply be pushed up into the casing 2, by the user gripping the trim 5 and aligning it so that the top of the crown 38 abuts the lip 28 of the module 4, and then pushing upward (until the brim 41 of the trim 5 abuts the ceiling or wall or other building partition, at which point the friction clips 42 should have been squeezed between the crown 38 and the sidewall 10 (thereby securing the trim 5 to the casing 2.) The description is thus to be regarded as illustrative instead of limiting.

What is claimed is:

1. A recessed lighting unit comprising:

a casing having a closed top end, a side wall having a top edge that joins the closed top end, wherein the side wall extends downward from the closed top end so as to completely surround a cavity that is between the closed top end and an open bottom end of the casing that is defined by a bottom edge of the sidewall;

a light source module having a plurality of driver wires that are to be electrically connected to a plurality of building electrical power wires, respectively, inside the cavity of the casing;

a holding bracket disposed inside the cavity of the casing, the holding bracket comprising:

a frame having a border that encloses a frame opening, the frame opening being shaped such that a housing of the light source module is insertable through the frame opening; and an arm having a proximal end coupled to the frame and a distal end positioned above the frame, the arm including a slot that runs along a length of the arm between the proximal end and the distal end; and an attaching member, disposed on the sidewall of the casing, that extends into the cavity of the casing and passes through the slot of the arm thereby substantially constraining the arm to the sidewall such that the arm is slidably adjustable along the slot relative to the attaching member.

2. The recessed lighting unit of claim 1 further comprising:

a trim having a crown that has a frusto-conical shape, wherein the crown has a base with a base opening formed therein, a top with a top opening formed therein, wherein light to be emitted from the source module is to pass through the crown by passing through the top opening and then through the base opening before illuminating a room, and a frustum that extends from the base to the top, and a brim that is attached to the base and encircles the base opening.

3. The recessed lighting unit of claim 2 further comprising a twist and lock mechanism formed on a lip of the light source module and on a top of the crown of the trim.

4. The recessed lighting unit of claim 2 wherein the crown has a height, as measured vertically from a top flat surface of the brim to a top of the crown that abuts the light source module, that is in the range of 0.5 inch to 2 inches.

5. The recessed lighting unit of claim 2 further comprising a plurality of friction clips anchored to the crown for attaching the trim to the sidewall of the casing.

6. The recessed lighting unit of claim 1 wherein the closed top end or sidewall of the casing has a knockout that is to be opened to reveal a hole, through which the building electrical power wiring is routed into the casing.

7. The recessed lighting unit of claim 1 wherein the sidewall of the casing has a horizontal cross section that is shaped as a polygon.

8. The recessed lighting unit of claim 7 wherein the casing is folded into shape from a flat sheet of metal.

9. The recessed lighting unit of claim 8, wherein the metal is galvanized steel.

10. The recessed lighting unit of claim 1 wherein the casing has a plurality of knockouts formed therein any one of which is to be used for bringing building electrical power wires, that are directly connected to another recessed lighting unit in the building without passing through a junction box, into the casing, to power the light source module in the casing.

11. The recessed lighting unit of claim 1 wherein a lip of the light source module is attached to the border of the frame of the holding bracket.

12. A recessed lighting unit comprising:

a casing having a side wall that surrounds a cavity and defines a bottom end opening;

a holding bracket disposed inside the cavity, the holding bracket comprising:

a frame having a frame opening; and an arm that extends upwards from the frame, the arm having a slot; and an attaching member positioned on the side wall of the casing, the attaching member extending into the cavity of the casing and passing through the slot of the arm to couple the arm to the side wall, wherein the holding bracket is slidable within the cavity along the slot of the arm.

13. The recessed lighting unit of claim 12, wherein the casing has a horizontal cross section that is shaped as a polygon.

14. The recessed lighting unit of claim 13, wherein the polygon is a pentagon, hexagon, heptagon, octagon, nonagon, or decagon.

15. The recessed lighting unit of claim 14, wherein the frame has a polygonal outer edge that has the same number of sides as the horizontal cross section of the casing.

16. The recessed lighting unit of claim 12, wherein the casing is folded into shape from a flat sheet of metal.

17. The recessed lighting unit of claim 16, wherein the metal is galvanized steel.

18. The recessed lighting unit of claim 12, wherein each of the attaching members comprises a threaded pin, the lighting unit further comprising:

a plurality of nuts, each coupled to the threaded pin of a corresponding attaching member so that the arm of the holding bracket is held between the nut and a sidewall of the casing.

19. The recessed lighting unit of claim 12, wherein the frame is positioned entirely inside of the casing when the holding bracket has been slid to an innermost position within the cavity.

20. The recessed lighting unit of claim 19, wherein the frame is positioned entirely outside of the casing when the holding bracket has been slid to an outermost position, wherein the outermost position is when the attaching member abuts an inner top end of the arm that is defined by the slot.

21. The recessed lighting unit of claim 12, further comprising:

a light source module having a base opening from which light is emitted by the module to illuminate a room, a housing extending longitudinally rearward from the base opening, and a lip extending laterally outward from the base opening, wherein the light source module is coupled to a bottom surface of the frame along the lip, while a portion of the housing of the light source module fits through the frame opening of the frame.

22. The recessed lighting unit of claim 21, further comprising:

a trim having an annular region through a central opening of which light from the light source module is to pass through for illuminating the room;

means for attaching the trim to the light source module; and means for attaching the annular region to the sidewall of the casing.

23. The recessed lighting unit of claim 12, further comprising:

a plurality of hangar bars positioned outside of the casing and coupled to the casing.

24. A recessed lighting unit comprising:

a casing having a sidewall that surrounds a cavity and defines an opening, the cavity having a cross section that is a polygon;

a holding bracket, disposed inside the cavity, to couple a lighting module to the casing, the holding bracket including an arm with a slot; and an attaching member, coupled to the sidewall of the casing, that passes through the slot of the arm such that the holding bracket is slidably adjustable relative to the cavity along an axis defined by the slot.

25. The recessed lighting unit of claim 24, wherein:

the holding bracket comprises a frame having a frame opening, the frame opening being shaped such that a housing of the light source module is insertable through the frame opening; and the arm has a proximal end coupled to the frame and a distal end, the proximal end and the distal end defining a longitudinal axis of the arm that is oriented orthogonal to a plane parallel to the opening of the casing.

26. The recessed lighting unit of claim 25, wherein the frame includes a first opening that aligns with a second opening on a lip of the lighting module, the first opening being configured to receive at least one of a screw, bolt, or pin to couple the lighting module to the holding bracket.

* * * * *